United States Patent [19]

Wuthrich

[11] 4,188,778

[45] Feb. 19, 1980

[54] CASEBACK WITH NONCIRCULAR, MULTILOBED SNAP-FIT SURFACE

[75] Inventor: Paul Wuthrich, Watertown, Conn.

[73] Assignee: Timex Corporation, Waterbury, Conn.

[21] Appl. No.: 924,779

[22] Filed: Jul. 14, 1978

[51] Int. Cl.[2] ..... G04B 37/00

[52] U.S. Cl. ..... 58/88 R; 58/90 R

[58] Field of Search ..... 58/53-56, 58/88 R, 88 C, 88 M, 90 R, 91, 94; 220/305, 306, 308

[56] References Cited

U.S. PATENT DOCUMENTS

| | | | |
|---|---|---|---|
| 1,488,458 | 3/1924 | Ecaubert | 58/90 R |
| 2,495,552 | 1/1950 | Schmitz | 58/90 R |
| 2,720,748 | 10/1955 | Gisiger | 58/90 R |
| 2,737,010 | 3/1956 | Piquerez | 58/90 R |

FOREIGN PATENT DOCUMENTS

| | | | |
|---|---|---|---|
| 824470 | 7/1949 | Fed. Rep. of Germany | 58/90 R |
| 1076730 | 5/1953 | France | 58/90 R |
| 1408872 | 7/1964 | France | 58/88 R |
| 374937 | 10/1963 | Switzerland | 58/88 R |
| 561440 | 4/1975 | Switzerland | 58/88 R |

*Primary Examiner*—Vit W. Miska
*Attorney, Agent, or Firm*—Edward J. Timmer

[57] ABSTRACT

A timepiece comprises a case and a back cover with improved snap-fitting means for releasably fastening the cover to the case. The back cover includes as improved snap-fitting means a peripheral engagement surface of noncircular, multilobal cross-section having a lobal diameter selected in relation to the diameter of a circular engagement surface on the case such that said surfaces are in snap-fit relation only at multiple, spaced locations, rather than along their entire peripheries, whereby the engagement surface of the back cover can flex elastically between the spaced contact locations and thus facilitate removal and attachment of the back cover by snap-fitting.

11 Claims, 6 Drawing Figures

CASEBACK WITH NONCIRCULAR, MULTILOBED SNAP-FIT SURFACE

FIELD OF THE INVENTION

The present invention relates to watch constructions and, more particularly, to constructions of the type having a back cover member snap-fitted to a case to cover an access opening in the latter.

DESCRIPTION OF THE PRIOR ART

The use of the so-called snap-fitting technique to assemble watch components such as the crystal, bezel, movement and back cover to the watch case is common, for example, see the Gisiger patent, U.S. Pat. No. 2,720,748; the Dinstman patent, U.S. Pat. No. 2,799,134; the Fujimori patent, U.S. Pat. No. 3,686,882; the Miyashita patent, U.S. Pat. No. 3,696,608 and the Grohoski et al patent, U.S. Pat. No. 4,067,186. Snap fitting generally involves elastic engagement of two or more of the components by means of cooperation between a circumferencial lip, flange or rib on one component and a corresponding groove, shoulder or the like on the other component. A typical and well known example is the engagement of the back cover, also referred to as caseback, to the watch case wherein the back cover includes an inwardly directed circumferential lip and the case includes an outer circumferential groove to receive the lip and thereby hold the components together. Usually, sealing means in the form of an annular gasket is placed between the back cover and case to provide a watertight joint. Although the circumferential engagement system just described functions satisfactorily to hold the back cover and case together, it suffers from the disadvantage that attachment of the back cover by hand manipulation is often difficult as a result of the need for alignment and engagement of the components accurately along their entire circumference and of the inability of the back cover to flex to a sufficient extent to accommodate slight mismatch between the components. Removal of the caseback for purposes of battery replacement, repair or the like is likewise often difficult for similar reasons.

SUMMARY OF THE INVENTION

Accordingly, it is an object of the present invention to provide a watch construction of the type having a back cover member snap-fitted to the case wherein attachment and removal of the back cover are significantly facilitated, especially in terms of manual attachment and removal, while a watertight joint between the components is maintained.

In a typical embodiment of the present invention, the timepiece includes a case with an access opening and an engagement surface of circular cross-section on the back side, a back cover member snap-fitted to the engagement surface to cover said access opening and sealing means disposed between the case and back cover member to prevent ingress of moisture into the case. A primary feature of the present invention is a back cover member which includes as improved snap-fitting means a peripheral engagement surface of noncircular, multilobed cross-section having a lobal diameter selected in relation to the diameter of the circular engagement surface of the case such that the surfaces are in snap-fit relation only at multiple, spaced locations equal in number to the number of lobes on the noncircular suraface. As a result, the engagement surface of the back cover member can flex elastically between the spaced contact areas and thereby facilitate removal and attachment of said member by snap-fitting. Sealing means positioned between the back cover member and case provides a watertight joint between the components.

In a preferred embodiment of the invention, the back cover member includes a peripheral rib projecting toward the case, the rib having a trilobal engagement surface (lobes spaced 120 apart) for cooperating in snap-fit relation with the circular engagement surface of the case at three spaced contact areas. The trilobal engagement surface may comprise an inwardly directed or outwardly directed lip for effecting an external or internal snap-fit relation with the case.

BRIEF DESCRIPTION OF THE DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings, in which:

DESCRIPTION OF THE PREFERRED EMBODIMENT

Figure 1:
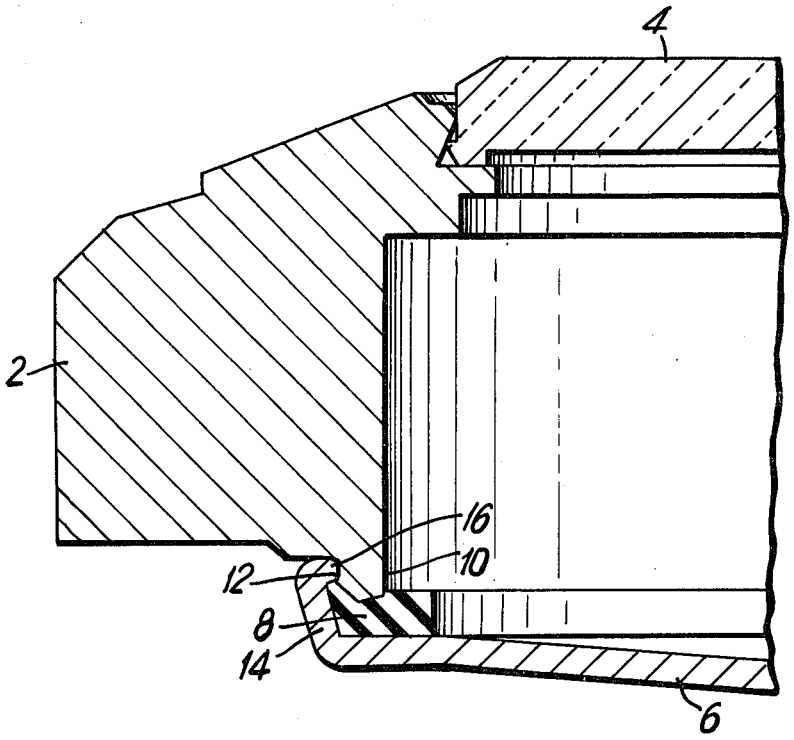
FIG. 1 is a partial elevation, in cross-section, of a timepiece illustrating a back cover member.

Referring first to FIG. 1, a watch construction in accordance with the present invention is shown as comprising a case 2 for containing a movement (not shown), a crystal 4 held by interference fit in known manner in the case, back cover member 6 snap-fitted to the case and gasket 8 positioned between the back cover member and case to prevent entry of moisture and dust. In addition, case 2 includes internal cylindrical wall 10 which defines an access opening of circular cross-section in the back side of the case for purposes of battery replacement, repair and the like. On the other hand, external wall 12 of the case defines a cylindrical engagement surface to which back cover member 6 is snap-fitted, as shown.

Figure 2:
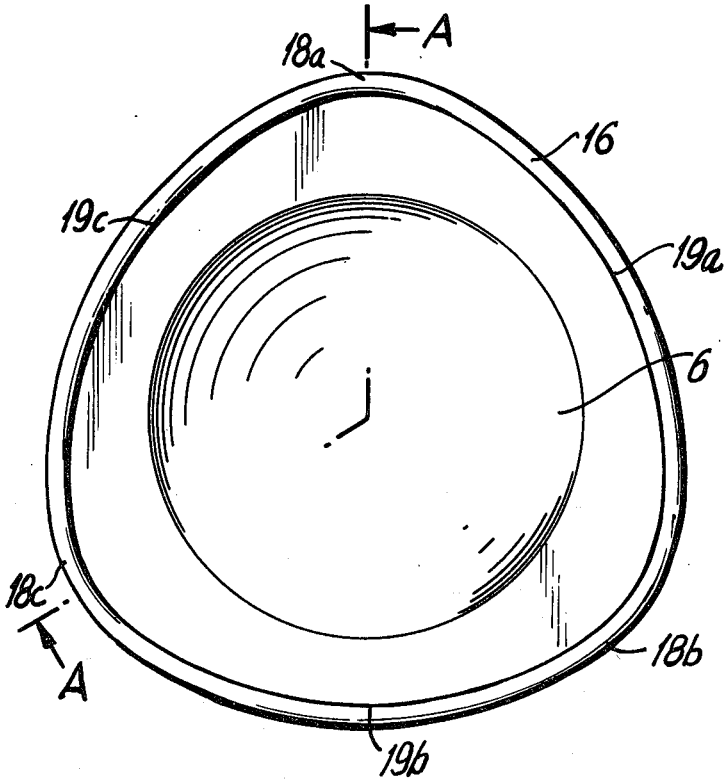
FIG. 2 is a plan view of a back cover member including an external snap-fit rib and lip of trilobal cross-section.
Figure 3:
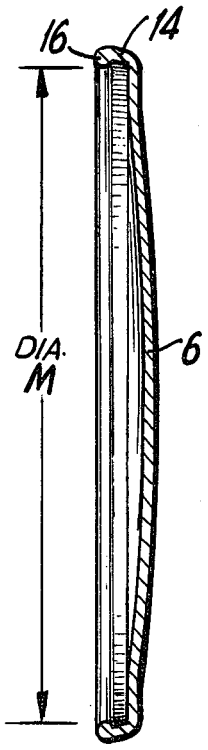
FIG. 3 is a cross-section along line A—A of FIG. 2.

In accordance with one embodiment of the present invention, back cover member 6 includes peripheral rib 14 projecting toward the case, the rib having an engagement surface in the form of inwardly directed lip 16 which cooperates with cylindrical surface 12 of the case to provide an external snap-fit. As shown more clearly in FIGS. 2 and 3, the projecting rib 14 and lip 16 have a noncircular, trilobal cross-section. In this instance, the back cover member exhibits the same cross-sectional shape as the rib and lip, as shown. It should be pointed out that the lobes 18*a*, 18*b*, 18*c*, of FIG. 2 are greatly exaggerated in order to illustrate the invention clearly. In actual practice, the noncircular shape of the cover member 6, rib 14 and lip 16 is barely discernible to the unaided eye. The lobal diameter M is shown in FIG. 3 and is selected in relation to the outer diameter of the wall 12 so that engagement surfaces 12 and 16 can be placed in snap-fit relation only at three spaced contact areas, corresponding to areas 19*a*, 19*b*, 19*c*, in the external snap-fit embodiment. The provision of spaced contact areas between engagement surfaces 12 and 16, rather than contact along their entire circumference as in the prior art, allows the rib 14 to be flexed elastically by one desiring to remove or attach the back cover member and thus greatly facilitates snap-fitting the back cover member onto the case or snapping it off the case. Of course, the gasket 8 disposed between the back cover member and case maintains a watertight joint between these components.

Figure 4:
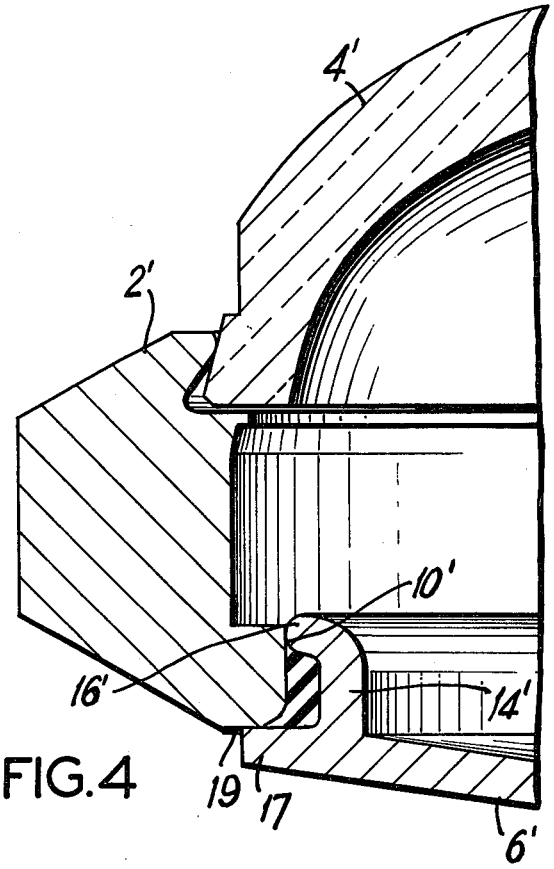
FIG. 4 is a partial elevation, in cross-section, of a timepiece illustrating a back cover member of the invention having an internal snap-fit rib to engage the case.
Figure 5:
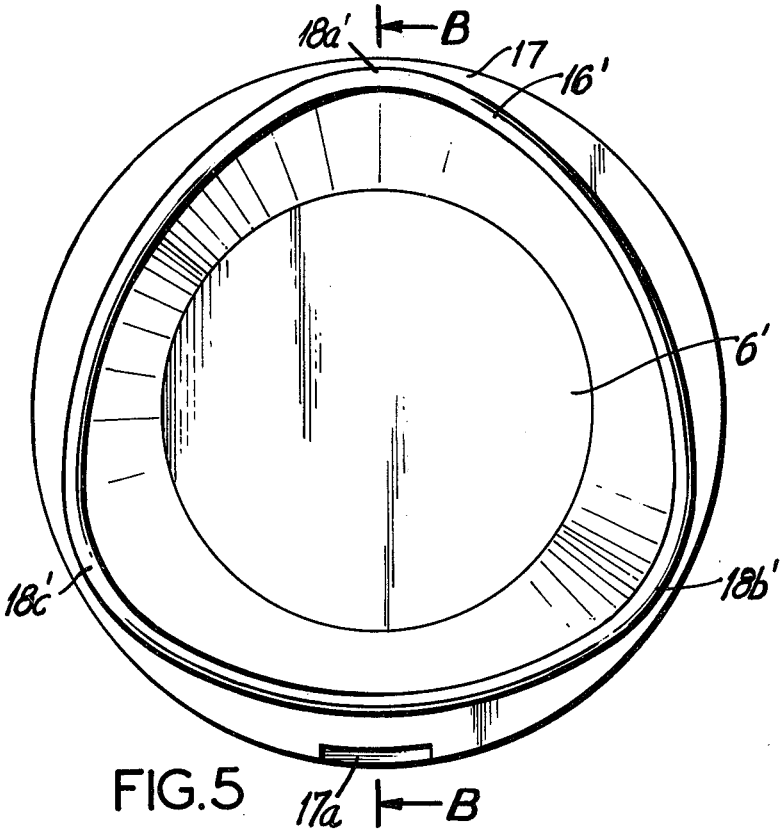
FIG. 5 is a plan view of a back cover member including an internal snap-fit rib and lip of trilobal cross-section.
Figure 6:
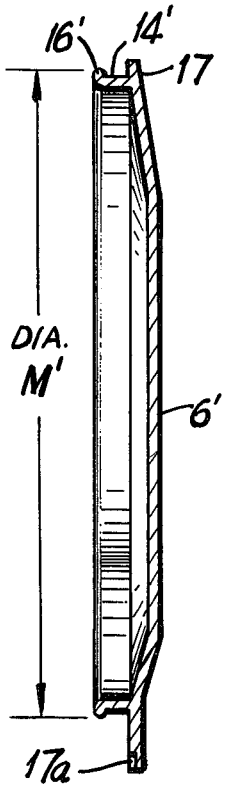
FIG. 6 is a cross-section along line B—B of FIG. 5.

FIGS. 4, 5, and 6 illustrate an embodiment of the invention for effecting an internal snap-fit between the case and back cover member. As is apparent, the essential components are basically the same as those discussed hereinabove with respect to FIGS. 1–3 and the like features are represented by like numerals (primed). In this embodiment, case 2' includes internal cylindrical wall 10' which not only defines an access opening in the back of the case but also forms the engagement surface of circular cross-section to which the back cover member 6' is snap-fitted. The back cover member includes peripheral rib 14' projecting toward the case and having an engagement surface in the form of outwardly directed peripheral rib 16'. Radial brim 17 may be formed as part of the back cover member and overlies and contacts the bottom surface 19 of the case. FIGS. 5 and 6 illustrate the noncircular, trilobal cross-sectional configuration of rib 14' and lip 16', the lobes 18*a'*, 18*b'*, and 18*c'*, again being greatly exaggerated for purposes of illustration. As shown, back cover member 6' has an overall circular cross-section as a result of radial brim 17. According to the invention, the outer lobal diameter M' is selected relative to the inner diameter of the access opening so that engagement surfaces 10' and 16' can be placed in snap-fit relation only at three spaced areas, corresponding to lobes 18*a'*, 18*b'*, 18*c'* in this internal snap-fit embodiment. Rib 14' can flex elastically between these lobal contact areas during removal or attachment by snap-fitting. Radial brim 17 may include a notch 17*a* or the like to receive a tool end to further facilitate removal of the back cover member.

Typically, the back cover member 6 or 6' would be made of metallic strip preferably stainless steel, although other materials such as plastic may also be utilized in the invention. Of course, the thickness of the material utilized for the back cover member can be varied within certain limits to impart different degrees of "elasticity" thereto during removal or attachment by snap-fitting.

Although the invention has been described in detail hereinabove with respect to a noncircular, trilobal engagement surface on back cover member 6 or 6', those skilled in the art will appreciate that the number of lobes may be varied as desired to achieve the desired degree of snap-fitting. In addition, rather than including lip 16 or 16', rib 14 or 14', may instead include a peripheral groove or other recess as the noncircular, multilobal engagement surface to cooperate in snap-fit relation with a corresponding protruding engagement surface on the case. Of course, other modifications may occur to those skilled in the art, and it is intended to cover in the appended claims all such modifications as fall within the spirit and scope of the invention.

I claim:

1. In a timepiece of the type having a case with an access opening and an engagement surface of circular cross-section on a back side and a back cover snap-fitted to the engagement surface to cover said opening, the improvement which comprises:

a back cover member having improved snap-fitting means for facilitating attachment and removal of said cover member to the case, said snap-fitting means comprising a peripheral engagement surface of noncircular, multilobed cross-section having a lobal diameter selected in relation to the diameter of the circular engagement surface of the case such that said engagement surfaces are in snap-fit relation only at multiple, spaced locations corresponding in number to the number of lobes on said circular engagement surface;

whereby said noncircular engagement surface can flex elastically between said spaced locations and thus facilitate snap-fitting of said back cover member to and from said case at any circumferential position of the back cover relative to the case.

2. The timepiece of claim 1 wherein:

sealing means is disposed between the back cover member and case to prevent entry of foreign matter into the case.

3. The timepiece of claim 1 wherein:

the noncircular engagement surface of said back cover member includes three lobes spaced 120° apart.

4. The timepiece of claim 1 wherein:

the noncircular engagement surface of said back cover member establishes an external snap-fit with the circular engagement surface of said case.

5. The timepiece of claim 1 wherein:

the noncircular engagement of surface of said back cover member establishes an internal snap-fit with the circular engagement surface of said case.

6. In a timepiece of the type having a case with an access opening and engagement surface of circular cross-section on a back side, a back cover member snap-fitted to the engagement surface to cover said opening and sealing means disposed between the case and back cover member to prevent entry of foreign matter, such as water, into the case, the improvement which comprises:

a back cover member having improved snap fitting means for facilitating attachment and removal of said cover member to the case, especially by hand manipulation, while retaining resistance to foreign matter intrusion provided by said sealing means, said snap-fitting means comprising a peripheral rib projecting from the cover member toward the case for engagement with said circular engagement surface, said rib having an engagement surface of noncircular, multilobed cross-section with a lobal diameter selected in relation to the diameter of the circular engagement surface of said case such that said engagement surfaces are in snap-fit relation only at multiple, spaced locations corresponding in number to the number of lobes on said noncircular engagement surface, whereby said rib can flex elastically between said spaced locations and thus facilitate snap-fitting of said back cover member to and from said case at any circumferential position of the back cover relative to the case.

7. The timepiece of claim 6 wherein:

the rib itself is configured to have a noncircular multi-lobed cross-section.

8. The timepiece of claim 7 wherein:

the rib includes as its engagement surface an inwardly directed lip therearound for effecting an external snap-fit, said lip having a selected inner lobal diameter to effect said multiple, spaced contacts.

9. The timepiece of claim 7 wherein:

the rib includes as its engagement surface an outwardly directed lip therearound for effecting an internal snap-fit, said lip having a selected outer lobal diameter to effect said multiple, spaced contacts.

10. The timepiece of claim 9 wherein:

the back cover member includes a radial brim extending beyond the rib, said brim overlying the case to give said back cover member an overall circular cross-sectional configuration.

11. The timepiece of claim 7 wherein:

the rib and its engagement surface have three lobes spaced 120° apart.

* * * * *

UNITED STATES PATENT AND TRADEMARK OFFICE

CERTIFICATE OF CORRECTION

PATENT NO. : 4,188,778

DATED : February 19, 1980

INVENTOR(S) : Paul Wuthrich

It is certified that error appears in the above-identified patent and that said Letters Patent are hereby corrected as shown below:

Column 4, lines 19 - 20 (claim 1): change

"said circular engagement surface" to --said noncircular engagement surface".

Signed and Sealed this

*Twenty-fourth* Day of *June 1980*

[SEAL]

*Attest:*

SIDNEY A. DIAMOND

*Attesting Officer*

*Commissioner of Patents and Trademarks*